US010767445B2

(12) United States Patent
Stachowiak, Jr. et al.

(10) Patent No.: US 10,767,445 B2
(45) Date of Patent: Sep. 8, 2020

(54) VALVE ASSEMBLY FOR DOWNHOLE PUMP OF RECIPROCATING PUMP SYSTEM

(71) Applicant: Weatherford Technology Holdings, LLC, Houston, TX (US)

(72) Inventors: John E. Stachowiak, Jr., Houston, TX (US); Santhosh Ramaswamy, Houston, TX (US); Jason W. Bailey, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 157 days.

(21) Appl. No.: 15/981,677

(22) Filed: May 16, 2018

(65) Prior Publication Data

US 2019/0353003 A1 Nov. 21, 2019

(51) Int. Cl.
*E21B 34/08* (2006.01)
*E21B 43/12* (2006.01)
*E21B 34/00* (2006.01)

(52) U.S. Cl.
CPC ..... *E21B 34/08* (2013.01); *E21B 43/127* (2013.01); *E21B 2034/002* (2013.01)

(58) Field of Classification Search
CPC .. E21B 34/08; E21B 43/127; E21B 2034/002; F16K 15/04; F16K 27/00; F16K 27/0254
USPC ..... 417/454, 554; 137/533.13, 533.15
See application file for complete search history.

(56) References Cited

U.S. PATENT DOCUMENTS 3,724,496 A * 4/1973 Secrist ..... F16K 15/04 137/533.13
4,685,517 A * 8/1987 Baggett ..... F04B 53/126 166/105
5,593,289 A 1/1997 Tarpley
5,593,292 A 1/1997 Ivey
6,029,685 A 2/2000 Carruth
6,283,148 B1 * 9/2001 Spears ..... F04B 53/1005 137/533.11

(Continued)

OTHER PUBLICATIONS

Don-Nam, "Insert Guided Cage," Brochure, undated, obtained from www.dan-nan.com on Apr. 24, 2018, 1-pg.

(Continued)

*Primary Examiner* — Michael R Wills, III
(74) *Attorney, Agent, or Firm* — Blank Rome LLP

(57) ABSTRACT

A downhole pump used for a reciprocating pump system includes a barrel coupling to a tubing string and having a standing valve and includes a plunger coupling to a rod string and having a traveling valve. One or both of the valves can include an assembly comprising a housing, an insert, a ball, and a seat. The insert allowing for flow therethrough defines a ball stop at one end has a ball passage at the other end. The insert positions in flow passage of the housing, and one of the ends engages a shoulder in the passage. The insert is secured in the flow passage with metallic material metallurgically affixed between at least a portion of the insert and the flow passage. For example, brazing material can be brazed at the end of the insert to metallurgically affix the insert in the passage. The ball is positioned in the insert, and the seat is positioned adjacent an end of the insert. The assembly is then incorporated into components of the pump.

29 Claims, 8 Drawing Sheets

(56) References Cited

U.S. PATENT DOCUMENTS

| | | | | |
|---|---|---|---|---|
| 6,685,451 | B1 * | 2/2004 | Ivey | F04B 47/02 137/533.19 |
| 7,069,997 | B2 * | 7/2006 | Coyes | F04B 53/1007 137/533.11 |
| 10,184,314 | B1 * | 1/2019 | Bair | E21B 34/06 |
| 2009/0223574 | A1 * | 9/2009 | Montague | E03B 9/16 137/519.5 |
| 2010/0269928 | A1 | 10/2010 | Ford | |

OTHER PUBLICATIONS

Schlumberger, "Insert Guided Cage," Brochure, copyright 2018, 1-pg.

* cited by examiner

VALVE ASSEMBLY FOR DOWNHOLE PUMP OF RECIPROCATING PUMP SYSTEM

BACKGROUND OF THE DISCLOSURE

Reciprocating pump systems, such as sucker rod pump systems, extract fluids from a well and employ a downhole pump connected to a driving source at the surface. A rod string connects the surface driving force to the downhole pump in the well. When operated, the driving source cyclically raises and lowers the downhole plunger, and with each stroke, the downhole pump lifts well fluids toward the surface.

For example, FIG. 1 shows a sucker rod pump system 10 used to produce fluid from a well. A downhole pump 14 has a barrel 16 with a standing valve 24 located at the bottom. The standing valve 24 allows fluid to enter from the wellbore, but does not allow the fluid to leave. Inside the pump barrel 16, a plunger 20 has a traveling valve 22, which allows fluid to move from below the plunger 20 to the production tubing 18 above, but does not allow fluid to return from the tubing 18 to the pump barrel 16 below the plunger 20. A driving source (e.g., a pump jack or pumping unit 26) at the surface connects by a rod string 12 to the plunger 20 and moves the plunger 20 up and down cyclically in upstrokes and downstrokes to lift fluid to the surface.

Various types of valve assemblies have been used for the standing and traveling valves of a downhole pump. For example, FIG. 2A illustrates a one-piece valve assembly 30A according to the prior art, which can be used for a standing valve or a traveling valve of a downhole pump. The assembly 30A includes a housing 40 having uphole and downhole ends 44 and 46 with a flow passage 42 therethrough. The ends 44 and 46 have threads for threading to other components of a pump system. An internal cage 50 is integrally machined inside the flow passage 42. A ball (not shown) inserts in the internal cage 50, and a seat (not shown) inserts in the flow passage 42 to engage an internal shoulder 55. A pin-threaded component can then thread to the thread at the housing's downhole end 46 to retain the seat and ball in the cage 50.

The cage 50 includes a stop 52 to stop the ball and include flutes 54 in the flow passage 42 that allow flow to pass the ball when engaged with the stop 52. Axial rails or ball guides 56 between the flutes 54 provide support for the ball in its movement.

Being integral, the housing 40 and internal cage 50 are composed of the same material. In many cases, they are made of a stainless steel, a nickel-copper alloy, MONEL® metal, or the like. (MONEL is a registered trademark of HUNTINGTON ALLOYS CORPORATION.) It is common to line the rails 56 and even the stop with 52 with a cobalt-chromium alloy, such as a STELLITE® material, to provide hardness for supporting and engaging the ball. (STELLITE is a registered trademark of KENNAMETAL INC.) A welding process, such as tungsten inert gas (TIG) welding, is used to line the hardening alloy on the surfaces, which can be complicated.

As can be seen from this example in FIG. 2A, forming the internal cage 50 and making threads 44, 46 requires a considerable amount of machining and manipulation. Coating internal surfaces of the cage 50 with a hard alloy requires additional manufacturing and precision.

Rather than a one-piece assembly, multi-piece assemblies can be used. For example, FIG. 2B illustrates one type of two-piece valve assembly 30B according to the prior art, which can be used for a standing valve or a traveling valve of the downhole pump. Again, the assembly 30B includes a housing 40 having uphole and downhole ends 44 and 46 with a flow passage 42 therethrough. The ends 44 and 46 have threads for threading to other components of a pump system.

An insert 60 is separately machined and inserted inside the flow passage 42 to engage its upper end 64 against a shoulder 45. A ball B inserts in the insert 60, and a seat 70 inserts in the flow passage 42 to engage the lower end 66 of the insert 60. To provide sealing, a spacer 72 with a seal 74 fits against the seat 70. A pin-threaded component can then thread to the downhole end 46 to retain the spacer 72, the seat 70, the ball B, and the insert 60.

The insert 60 includes a stop 62 to stop the ball B and includes flutes 65 in the flow passage 42 that allow flow to pass the ball B when engaged with the stop 62. Axial rails or ball guides 67 between the flutes 65 provide support for the ball B in its movement. Because the insert 60 is a separate component, it can be made of a different material than the housing 40 and can be made, for example, of a STELLITE® material.

The spacer 72 and the seal 74 are needed because fluid can leak past the end 66 of the insert 60 engaged on the seat 70 and can leak around the outside of the seat 70. For example, if the assembly 30B is used as a traveling valve in a downhole pump, fluid at higher pressure in the plunger during an upstroke may leak to the lower pressure of the barrel. This leakage, if allowed to enter the threads at the downhole end 46, can erode the threads of the pump during operation. The spacer 72 with the seal 74 helps reduce leakage.

The components of the insert 60, the seat 70, and the spacer 72 are all sandwiched against the shoulder 45 by the threading of an adapter at the housing's downhole end 46. This can produce compressive load on the insert 60, which can lead to distortion and failure. For this reason, this insert 60 has an increased wall thickness to handle the compressive load, which requires the assembly 30B to be used with a ball B smaller than a standard API-sized ball.

FIG. 2C illustrates another type of two-piece valve assembly 30C according to the prior art, which can be used for a standing valve or a traveling valve of the downhole pump. This assembly 30C is for use with a standard API-sized ball. Again, the assembly 30C includes a housing 40 having uphole and downhole ends 44 and 46 with a flow passage 42 therethrough. The ends 44 and 46 have threads for threading to other components of a pump system.

An insert 60 is separately machined and inserted inside the flow passage 42 to engage its lower end 66 against a shoulder 45. To retain the insert 60 and provide sealing, a gasket 63 is placed on the upper end of the insert 60, and an adapter 41 of the housing 40 threads to the uphole threads 44. To complete the assembly, a ball (not shown) inserts in the insert 60, and a seat (not shown) inserts in the flow passage 42 to engage the shoulder 45. A pin-threaded can then thread to the thread at the housing's downhole end 46 to retain the seat and ball in the housing 40.

The insert 60 includes a stop 62 to stop the ball and include flutes 65 in the flow passage 42 that allow flow to pass the ball when engaged with the stop 62. Axial rails 67 between the flutes 65 provide support for the ball. Because the insert 60 is a separate component, it can be made of a different material than the housing 40 and can be made, for example, of a STELLITE® material.

Because the insert-style assemblies 30B-C of FIGS. 2B-2C require the insert 60 to be both securely captivate and sealed in the flow passage 42, the typical method is to incorporate additional threaded members and to tighten them to sandwich the insert 60 against a housing shoulder 45. The compressive load placed on the insert 60 can lead to increased chances of failure and can disport its shape. For these and other reasons, such insert-style design has its drawbacks such as leaking, high temperature limitations, and manufacturing costs.

The subject matter of the present disclosure is directed to overcoming, or at least reducing the effects of, one or more of the problems set forth above.

SUMMARY OF THE DISCLOSURE

A method is disclosed of assembling a valve assembly of a downhole pump for a reciprocating pump system. The method comprises: inserting an insert in a flow passage of a housing. To position the insert, a charge of the metallic material can be initially positioned in a circumferential groove about the insert.

The housing has first and second ends and defines the flow passage therethrough. The flow passage defines a surface between the first and second ends, and the insert has third and fourth ends allowing for flow therethrough. The third end defines a ball stop, and the fourth end has a ball passage.

The method further comprises setting one of the third and fourth ends of the insert against the surface in the flow passage; and securing the insert in the housing by metallurgically affixing between at least a portion of the insert and the flow passage.

The method can further comprise positioning a ball movably disposed in the flow passage of the housing, engagable with the ball stop of the insert, and passable at least partially through the ball passage of the insert and can even further comprise positioning a ball seat in the flow passage adjacent the fourth end of the insert having the ball passage. To position the ball seat in the flow passage, for example, the ball seat can abut against the fourth end or can abut against an opposite side of the surface against which the fourth end abuts. Finally, the method can further comprise attaching the first end of the housing to a plunger of the downhole pump or to a barrel of the downhole pump.

The housing can be initially formed by machining the flow passage in the housing to define the surface between the first and second ends and by machining threads at the first and second ends for threading to other components of the downhole pump. The insert can be initially formed by casting the insert with the ball stop and the ball passage.

To machine the flow passage in the housing to define the surface between the first and second ends, the method can comprise forming a rim, a lip, a detent, a stop, or a shoulder in the flow passage, forming an inwardly angled portion of a sidewall of the flow passage, or forming a cylindrical portion of the sidewall of the flow passage.

A number of steps can be used to set the one of the third and fourth ends of the insert against the surface and to metallurgically affix between at least the portion of the insert and the flow passage. In particular, the steps involve: (i) engaging the third end of the insert against the surface, and metallurgically affixing between at least a portion of the fourth end of the insert and the flow passage; (ii) engaging the fourth end against the surface, and metallurgically affixing between at least a portion of the third end of the insert and the flow passage; (iii) engaging the third end of a body of the insert against the surface, inserting a spacer of the insert separate from the body toward the second end of the housing, and metallurgically affixing between at least a portion of the spacer and the flow passage; (iv) engaging the fourth end of a body of the insert against the surface, inserting a spacer of the insert separate from the body toward the first end of the housing, and metallurgically affixing between at least a portion of the spacer and the flow passage; or (v) engaging one of the third and fourth ends of the insert against the surface, and metallurgically affixing between at least a portion of both of the third and fourth ends of the insert and the flow passage.

To metallurgically affix between at least the portion of the insert and the flow passage, the method can comprise brazing with a brazing material between at least the portion of the insert and the flow passage. A charge of the brazing material can be initially positioned adjacent an annular space between the insert and the flow passage and applying heat adjacent the brazing material. The charge of the brazing material can be positioned in a circumferential slot around the insert. The heat can be applied using inductive heating with a coil disposed relative to the housing.

To metallurgically affix between at least the portion of the insert and the flow passage, the method can comprises soldering with a soldering material between at least the portion of the insert and the flow passage; or solid-state joining at least the portion of the at least one of the third and fourth ends of the insert in the flow passage.

According to the present disclosure, a downhole pump for a reciprocating pump system having a rod string disposed in a tubing string comprises a valve assembly assembled according to the method of disclosed above.

A valve assembly is disclosed for a downhole pump. The assembly comprises: a housing disposed on the pump, the housing having first and second ends and defining a flow passage therethrough, the flow passage defining a surface between the first and second ends; and an insert disposed in the housing, the insert having third and fourth ends allowing for flow therethrough, the third end defining a ball stop, the fourth end having a ball passage, at least one of the third and fourth ends engaging the surface of the housing, at least a portion of the insert metallurgically affixed to the flow passage.

The first end of the housing can define first threads for threading to a first component of the downhole pump, and the second end of the housing can define second threads for threading to a second component of the downhole pump.

A number of arrangements of the insert can be used. The third end of the insert can engage the surface, and at least a portion of the fourth end of the insert is metallurgically affixed to the flow passage. Alternatively, the fourth end of the insert can engage the surface, and at least a portion of the third end of the insert is metallurgically affixed to the flow passage.

In other arrangements, the third end of the insert can comprise a body of the insert engaging the surface, and the fourth end of the insert can comprise a spacer separate from the body of the insert. The spacer is disposed against the body and being metallurgically affixed in the flow passage. Alternatively, the fourth end of the insert can comprise a body of the insert engaging the surface, and the third end of the insert can comprise a spacer separate from the body of the insert. The spacer is disposed against the body and being metallurgically affixed in the flow passage. In a further alternative, the one of the third and fourth end of the insert can engage the surface, and at least a portion of both of the third and fourth ends of the insert are metallurgically affixed to the flow passage.

The assembly further comprises: a ball seat disposed in the flow passage adjacent the fourth end having the ball passage; and a ball movably disposed in the flow passage of the housing, engagable with the ball stop of the insert, passable at least partially through the ball passage of the insert, and seatable in the ball seat.

The ball seat can abut against the fourth end of the insert or can abut against an opposite side of the surface against which the fourth end of the insert abuts. The insert can define a circumferential groove thereabout and comprises a charge of metallic material therein. The flow passage can define an annular groove therein, wherein the insert has a charge of metallic material disposed thereon and positioned adjacent the annular groove.

The metallurgical affixation and the surface can secure the insert in the flow passage without compressive load across the third and fourth ends of the insert. Moreover, the metallurgical affixation can seal the insert in the flow passage preventing flow through an annular space between the insert and the flow passage.

A number of forms of metallurgical affixation can be used. In particular, a brazing material can braze at least the portion of the at least one of the third and fourth ends of the insert in the flow passage. In general, the housing can comprise a nickel-copper alloy; the insert can comprise a cobalt-chromium alloy; and the brazing material can comprise a silver-based alloy. In other arrangements, a soldering material can solder at least the portion of the at least one of the third and fourth end of the insert in the flow passage, or a solid-state weldment can join at least the portion of the at least one of the third and fourth ends of the insert in the flow passage.

A downhole pump is disclosed herein for a reciprocating pump system having a rod string disposed in a tubing string. The pump comprises: a barrel coupling to the tubing string and having a standing valve assembly; and a plunger coupling to the rod string and movably disposed in the barrel, the plunger having a traveling valve assembly. At least one of the standing and traveling valve assemblies comprises a valve assembly as disclosed above.

The foregoing summary is not intended to summarize each potential embodiment or every aspect of the present disclosure.

DETAILED DESCRIPTION OF THE DISCLOSURE

Figure 1A:
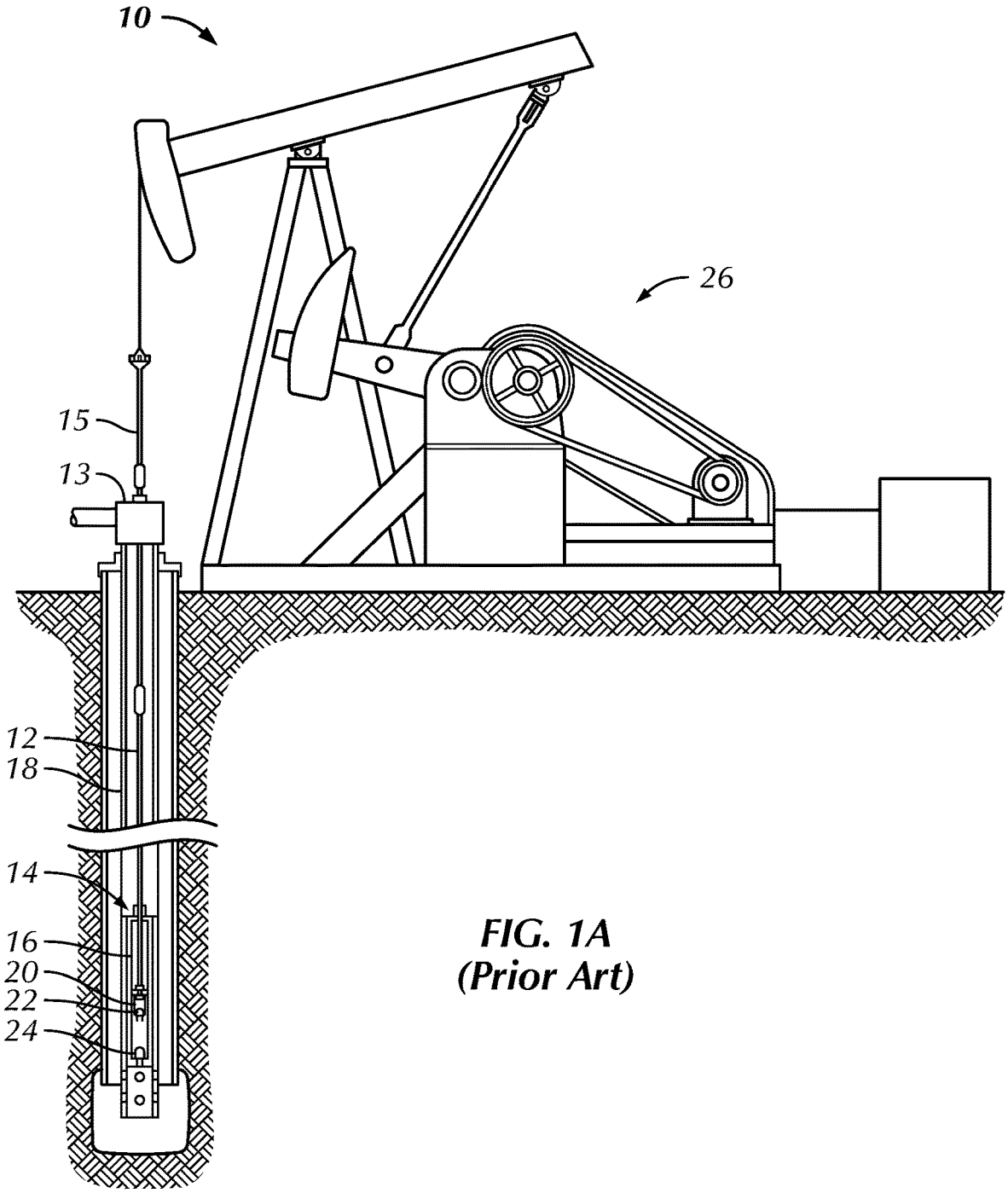
FIG. 1A (Prior Art)
FIG. 1 illustrates an example of a reciprocating rod pump system known in the art.
Figure 2C:
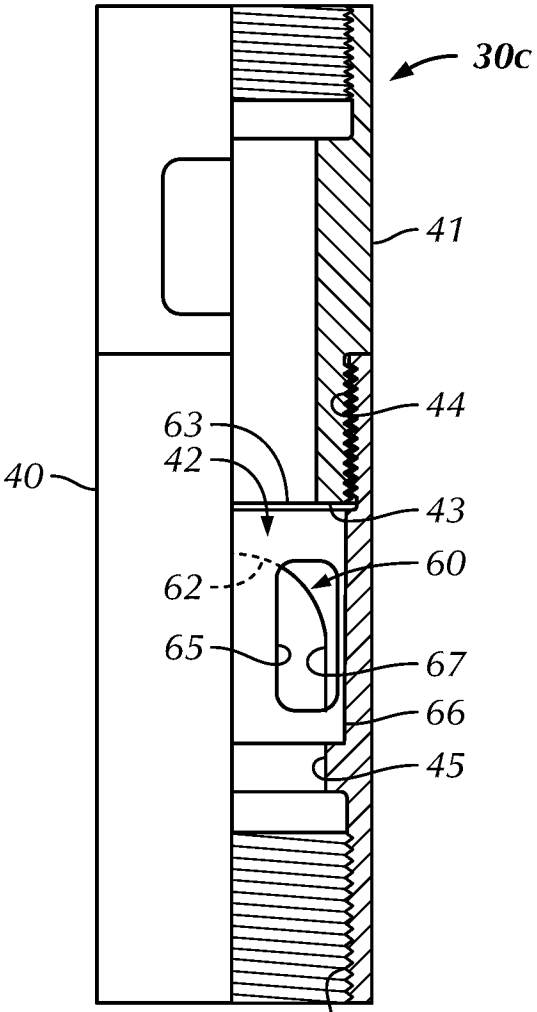
FIG. 2C (Prior Art)
FIG. 2C illustrates another type of two-piece valve assembly according to the prior art.
Figure 2B:
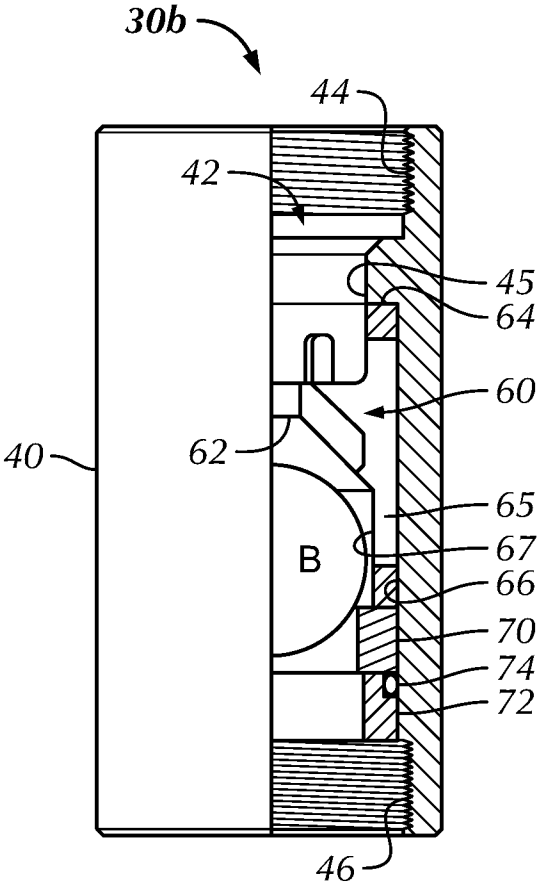
FIG. 2B (Prior Art)
FIG. 2B illustrates one type of two-piece valve assembly according to the prior art.
Figure 2A:
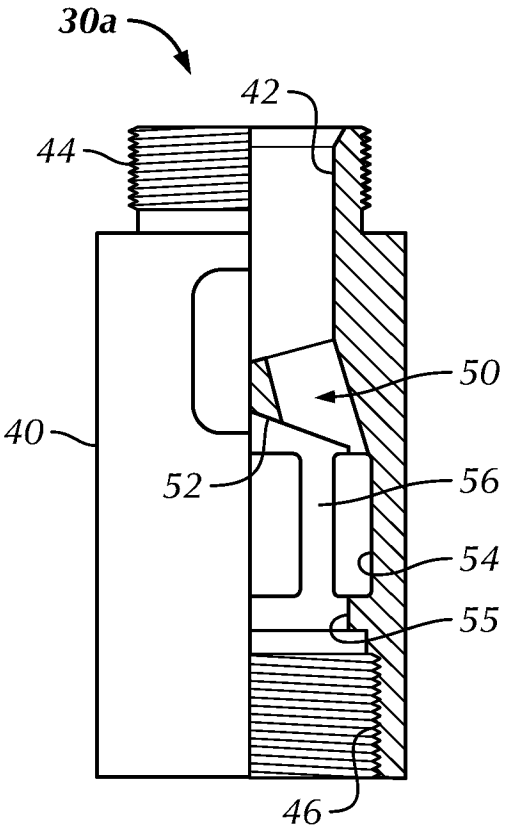
FIG. 2A (Prior Art)
FIG. 2A illustrates a one-piece valve assembly according to the prior art.
Figure 3:
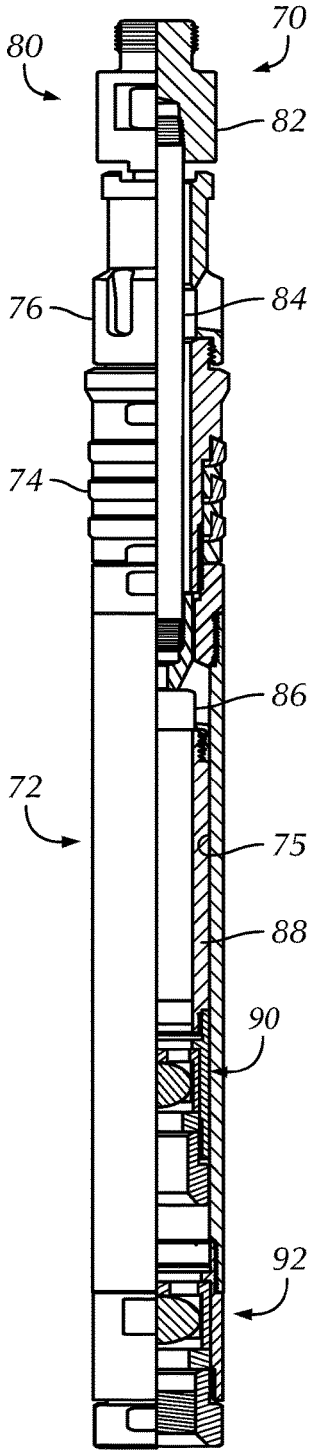
FIG. 3 illustrates a downhole pump of a reciprocating pump system according to the presented disclosure.

FIG. 3 illustrates a downhole pump 70 of a reciprocating pump system according to the presented disclosure. The downhole pump 70 has a stationary assembly having a barrel 72 connected to a seating assembly 74 and a top outlet 76. Various types of seating assemblies 74 can be used, and the one shown is only provided as an example. A standing valve assembly 92 is located at the bottom of the barrel 72. The standing valve assembly 92, which includes a cage, a ball, and a seat, allows fluid to enter the barrel 72 from a wellbore, but does not allow the fluid to leave.

A traveling assembly 80 connects at a coupling 82 to a rod string (not shown) used for reciprocating the traveling assembly 80. A rod 84 extends from the coupling 82 to a ported coupling 86 connected to a plunger 88, which is movably disposed in the barrel's internal chamber 75. The plunger 88 has a traveling valve assembly 90, which includes a cage, a ball, and a seat. The traveling valve assembly 90 allows fluid to enter from below the plunger 88, but does not allow fluid to leave.

As will be appreciated, the lengths of the barrel 72, rod 84, plunger 88 and the like are not shown to relative scale in FIG. 3 representative of the stroke of the pump 70. In any event, during the upstroke, the traveling valve assembly 90 is closed, and any fluid above the plunger 88 is lifted towards the outlet 76. Meanwhile, the standing valve assembly 92 opens and allows fluid to enter the pump barrel 72 from the wellbore. During the downstroke, the traveling valve assembly 90 is opened, and the standing valve assembly 92 closes. Previously drawn fluid in the barrel 72 can then enter through the traveling valve 90 to above the plunger 88.

The traveling valve assembly 90 and/or the standing valve assembly 92 use a valve assembly according to the present disclosure. Several configurations for the valve assemblies are disclosed below.

Figure 4A:
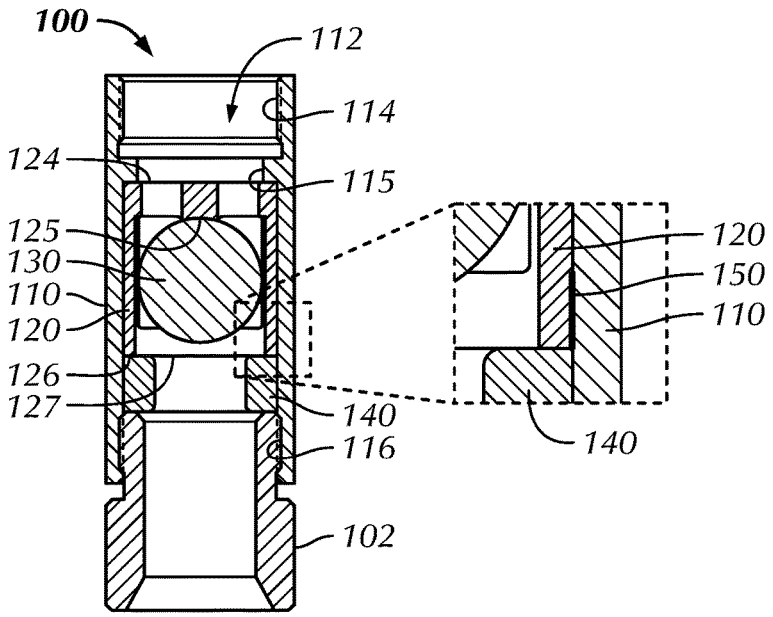
FIGS. 4A-4C illustrate different sectional views of a first type of a valve assembly for the downhole pump of FIG. 3
Figure 4B:
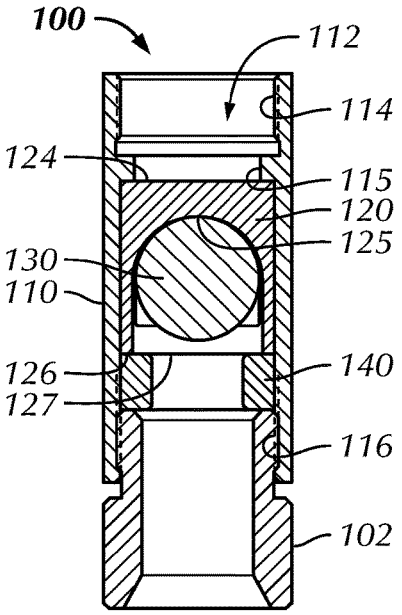
Figure 4C:
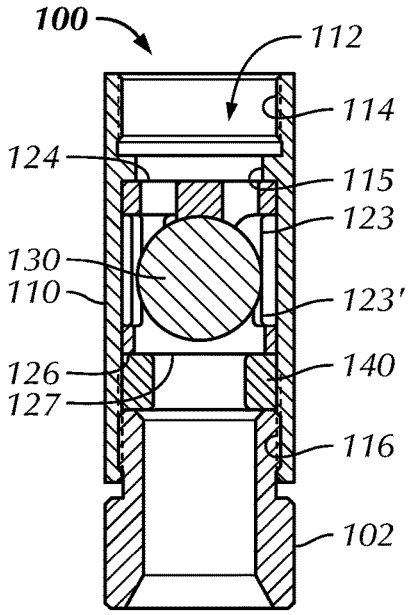

Turning to FIGS. 4A-4C, different sectional view of a valve assembly 100 for the downhole pump of FIG. 3 are shown. The valve assembly 100 includes a housing 110, an insert 120, a ball 130, and a seat 140. The housing 110 has first and second ends 114, 116 and defines a flow passage 112 therethrough. Internally, the flow passage 112 defines a surface 115 between the ends 114, 116. (The surface 115 here is a shoulder defined in the flow passage 112, but as will be detailed below, use of a shoulder is not strictly necessary. For example, the surface 115 can be a rim, lip, detent, stop, or the like. The surface 115 can be an angling of the sidewall to create an interference fit, or the surface 115 may simply be a point on the cylindrical sidewall of the flow passage 112.) As is typical, the ends 114, 116 have threads for threading to other components of the pump assembly. As shown here, the ends 114, 116 include box threads, but either one or both could be pin threads depending on the location of the valve assembly.

The insert 120 has ends 124, 126 allowing for flow therethrough. The upper end 124 defines a ball stop 125, and the lower end 126 defines a ball passage 127. Axial rails 123 divided by flutes 123' connect between the ends 124, 126. The rails 123 support the axial movement of the ball 130, while the flutes 123' allow for flow around the ball 130. The insert 120 can be a unitary piece as shown or can comprise more than one piece in an assembly. For example, as disclosed below, the insert 120 can comprise a body having the ball stop, and a spacer defining at least portion of the ball passage.

At least one of the ends 124, 126 engages the surface or shoulder 115, which in this case is the upper end 124. Here, the seat 140 inserts against the lower end 126 of the insert 120 and is held in place by an adapter 102 threaded to the thread of the downhole end 116 of the housing 110. The ball 130 is movable in the insert 120 to engage the stop 125 or to seat in the seat 140.

The insert 120 secures in the flow passage 112 with metallic material 150 metallurgically affixed between the flow passage 112 and at least a portion of the insert 120. As shown here, the metallic material 150 metallurgically affixes the lower end 126 of the insert 120 to the flow passage 112. This securing produces a seal that helps prevent fluid leakage from passing in the annulus between the insert 120 and the flow passage 112, which could leak past the seat 140 and potentially erode the thread at the connection of the housing's end 116 to the adapter 102.

The metallic material 150 can be comprised of a number of materials and can be metallurgically affixed in a number of ways. In one arrangement, the material 150 comprises a brazing material that metallurgically affixes between portion of the insert 120 and the flow passage 112 using a brazing process. In another arrangement, the material 150 comprises a soldering material that metallurgically affixes between portion of the insert 120 and the flow passage 112 using a soldering process. In yet another arrangement, the material 150 comprises weldment material that metallurgically affixes between portion of the insert 120 and the flow passage 112 using a solid state joining process. Variations of these are disclosed further below.

Once assembled, the metallic material 150 of the metallurgical affixing and the surface or shoulder 115 secure the insert 120 in the flow passage 112 without (or with at least reduced) compressive load across the insert's ends 124, 126. As noted, compressive load on the insert 120 could distort its shape and lead to premature failure. Additionally, the metallic material 150 seals the insert 120 in the flow passage 112 preventing flow through an annular space between the insert 120 and the flow passage 112. This sealing can help in preventing fluid leakage from damaging other components of a downhole pump, such as the threaded ends of the various components.

Figure 5C:
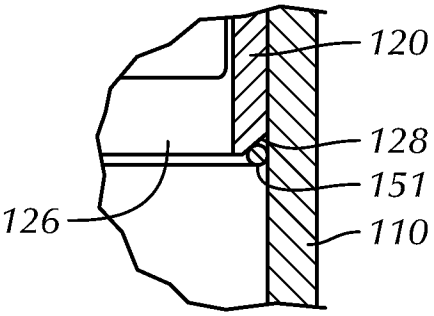
FIGS. 5C-5D illustrate details of the valve components in FIGS. 5A-5B.
Figure 5D:
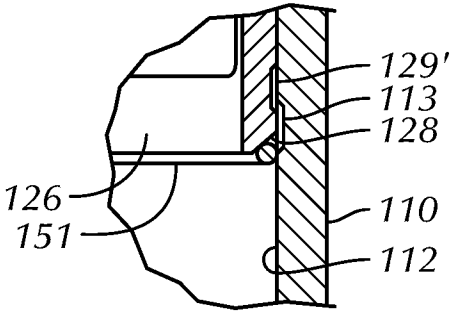
Figure 5B:
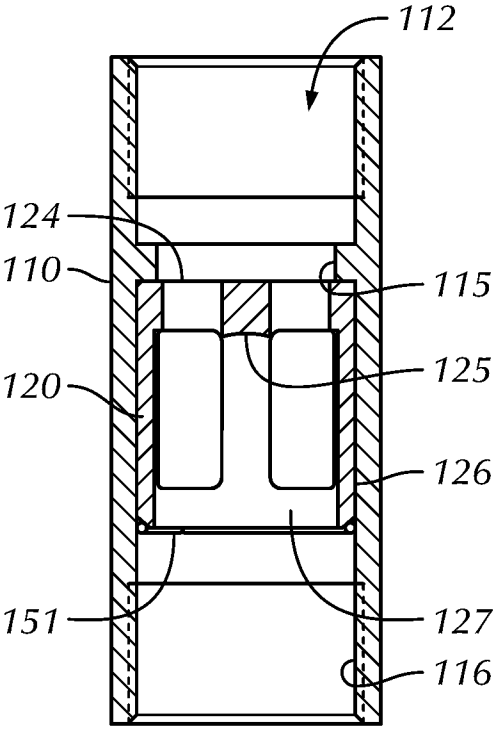
FIGS. 5A-5B illustrate sectional views of valve components during a stage of manufacture of the first type of valve assembly of the present disclosure.
Figure 5A:
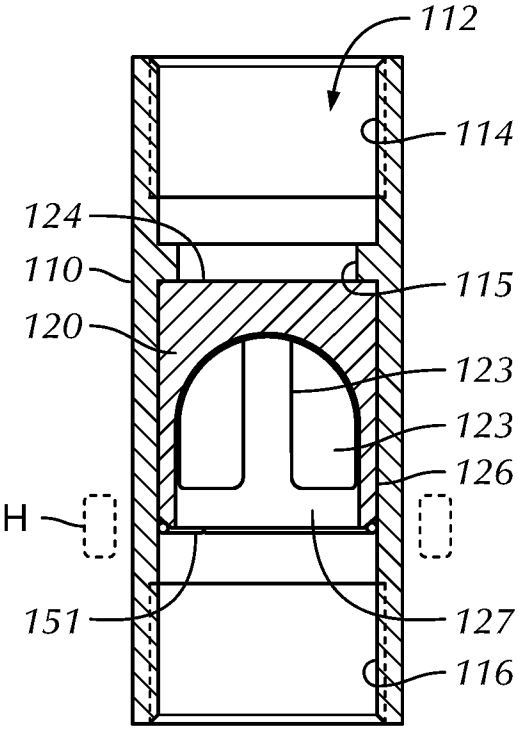

FIGS. 5A-5B illustrate sectional views of valve components during a stage of manufacture of this first type of valve assembly 100 of the present disclosure, such as the assembly 100 of FIGS. 4A-4C. Similar reference numbers are used for the same components between configurations.

In the manufacture, the insert 120 installs in the flow passage 112 with the upper end 124 engaging the surface or shoulder 115 near the uphole end 114 of the housing 110. If the surface 115 is a shoulder as shown, then the location of the insert 120 can be well-defined in the flow passage 112 for fitting additional components of seat, adapters, and the like. If another type of surface 115 is used, then the location of the insert 120 can be defined by a temporary fixture used in the flow passage 112 during assembly, such as during brazing or soldering as disclosed herein. This can allow the ends of the insert 120 to be properly spaced in the flow passage 112 for eventual coupling of the housing 110 to other components of the assembly.

A charge 151 of metallic material is positioned at the lower end 126 of the insert 120, and heating is applied to melt the charge 151 to form the metallurgical affixing between the lower end 126 of the insert 120 and the flow passage 112. An additional charge (not shown) of a brazing material could be used between the insert's upper end 124 and the surface or shoulder 115 if suitable.

The heating can be supplied by a heating appliance H. (Although not shown, the assembly 100 may be inverted so that gravity facilitate the wicking of the metallurgical affixing between the lower end 126 of the insert 120 and the flow passage 112.)

As shown specifically here, the charge 151 can be a ring, strip, coil or the like of metallic material, which can be soldering or brazing material. For soldering, the heating appliance H can heat the charge 151 of soldering material. For brazing, the heating appliance H can be an inductive coil disposed relative to the housing 110 to heat the charge 151 of brazing material. For friction welding, heating can also be used. In any of these arrangements, the heating appliance H can be disposed about and/or inside the housing 110. The heating can be performed in a number of ways, such as using an inductive coil, an oven, a heating torch or the like.

As best shown in the detail of FIG. 5C, a beveled edge 128 can be provided on the insert's lower end 126 to facilitate the placement of the charge 151 and wicking of the affixing material. As best shown in FIG. 5D, an inner annular slot 113 can be defined in the flow passage 112 of the housing 110 and/or an outer annular slot 129' can be defined around the outside of the insert's lower end 126 to facilitate the placement and wicking of the affixing material.

Once the insert 120 is metallurgically affixed, the configuration of FIGS. 5A-5B would then be assembled in a similar way to the assembly of FIGS. 4A-4C to include the seat (not shown) at the insert's lower end 126 and to include an adapter (not shown) at the housing's downhole end 116.

Although the housing 110 has the surface or shoulder 115 toward the uphole end 114 against which the upper end 124 of the insert 120 rests so the insert 120 can secure with the material 150 at the lower end 126, a reverse arrangement could be used. Thus, the housing 100 can instead have the surface or shoulder 115 toward the downhole end 116 against which the lower end 126 of the insert 120 rests so the insert 120 can secure with the material 150 at the upper end 124 of the insert 120.

Figure 6C:
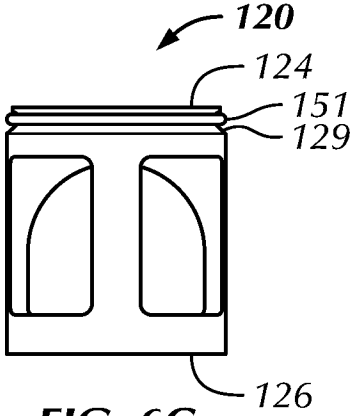
FIGS. 6C-6D illustrate details of the valve components in FIGS. 6A-6B.
Figure 6D:
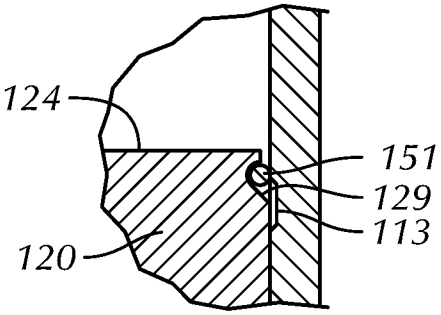
Figure 6B:
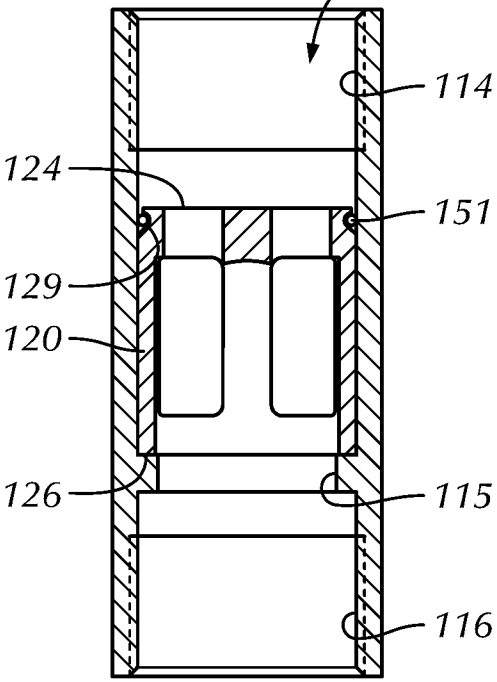
FIGS. 6A-6B illustrate sectional views of valve components during a stage of manufacture of a second type of valve assembly of the present disclosure.
Figure 6A:
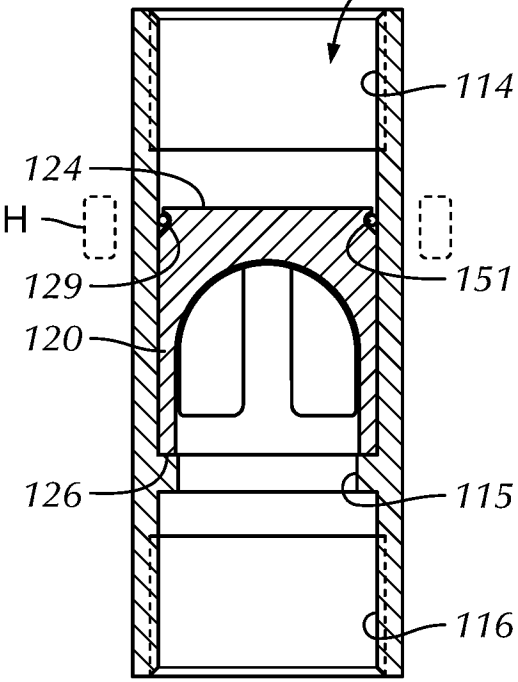

Turning to FIGS. 6A-6B, for example, sectional views of valve components are illustrated during a stage of manufacture of a second type of valve assembly 100 of the present disclosure. Similar reference numbers are used for the same components between configurations.

In the manufacture, the insert 120 installs in the flow passage 112 with the lower end 126 engaging the surface or shoulder 115 near the downhole end 116 of the housing 110. A charge 151 of metallic material is positioned at the upper end 124 of the insert 120, and heating is applied to melt the charge 151 to form the metallurgical affixing between the upper end 126 of the insert 120 and the flow passage 112. As before, the heating can be supplied by a heating appliance or inductive coil H.

As shown specifically here, the charge 151 can be a ring, strip, coil or the like of metallic material, which can be soldering or brazing material. As best shown in the detail of FIG. 6C, a circumferential slot 129 can be provided on the insert's upper end 124 to facilitate the placement of the charge 151 and wicking of the affixing material. As best shown in FIG. 6D, an inner annular slot 113 can be defined in the flow passage 112 of the housing 110 to facilitate the placement and wicking of the affixing material.

Once the insert 120 is metallurgically affixed, the configuration of FIGS. 6A-6B would then be assembled to include the seat (not shown) against the opposite side of the surface or shoulder 115 and to include a lower adapter (not shown) at the housing's downhole end 116. An upper adapter, plunger, barrel, or other component (not shown) can then be threaded at the housing's uphole end 114.

Figure 7A:
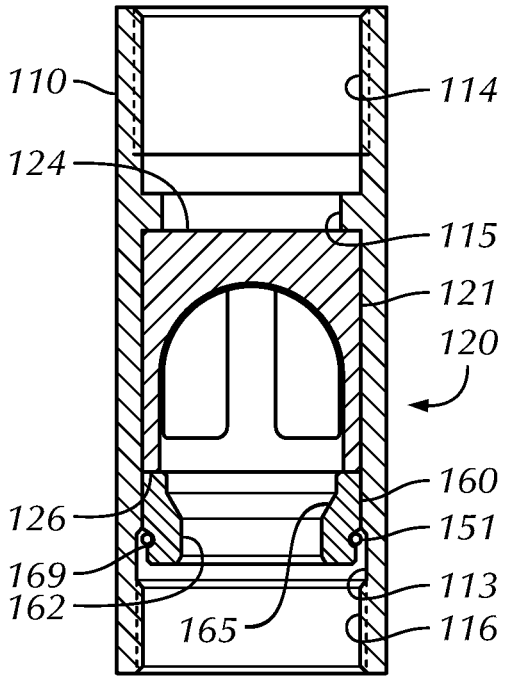
FIGS. 7A-7B illustrate sectional views of valve components during a stage of manufacture of a third type of valve assembly of the present disclosure.
Figure 7B:
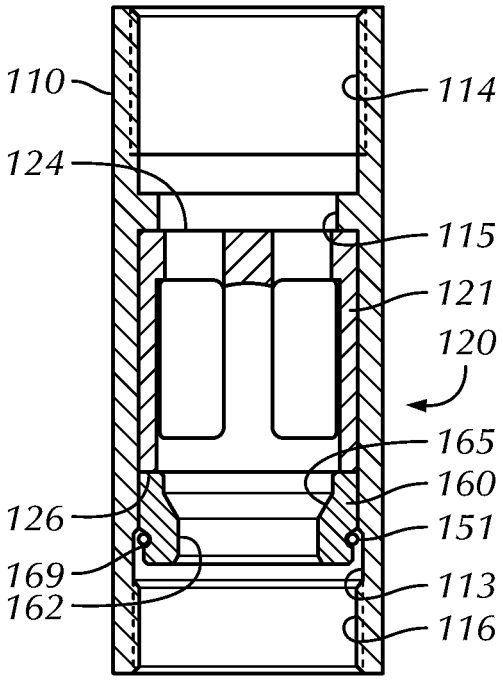

In the above configurations, the insert 120 has provisions to accept the charge 151. In alternative configurations, a "spacer" element of the insert 120 having such provisions can be used adjacent to a body of the insert 120. Turning to FIGS. 7A-7B, for example, sectional views of valve components are illustrated during a stage of manufacture of a third type of valve assembly 100 of the present disclosure. Similar reference numbers are used for the same components between configurations.

In the manufacture, the insert 120 includes a body 121 and a spacer 160 that install in the flow passage 112 with the insert's upper end 124 engaging the surface or shoulder 115 near the uphole end 114 of the housing 110. If suitable, an additional charge (not shown) of a brazing material could be used between the insert's upper end 124 and the surface or shoulder 115.

The spacer 160 of the insert 120 has a charge 151 of metallic material, and the spacer 160 is positioned at the lower end 126 of the body 121 of the insert 120, and heating is applied to melt the charge 151 to form the metallurgical affixing between the spacer 160 and the flow passage 112. As before, the heating can be supplied by a heating appliance or inductive coil (not shown).

As shown specifically here, the charge 151 can be a ring, strip, coil or the like of metallic material, which can be soldering or brazing material. As shown, a circumferential slot 169 can be provided around the spacer 160 and an annular slot 113 can be defined inside the flow passage 112 to facilitate the placement and wicking of the affixing material.

Once the insert 120 is metallurgically affixed, the configuration of FIGS. 7A-7B would then be assembled. An upper adapter (not shown) can then be threaded at the housing's uphole end 114. In one arrangement, the passage 162 in the spacer 160 may actually form the seat 165 for the ball (not shown). As expected, this would require insertion of the ball prior to the metallurgical affixing process. A lower adapter (not shown) could then connect at the housing's downhole end 116.

In alternative arrangement, the spacer 160 may include a larger passage 162 than shown, and the configuration could be assembled to include the seat (not shown) against the spacer 160 and to include a lower adapter (not shown) at the housing's downhole end 116. Gaskets (not shown) may be used for additional sealing.

Figure 8A:
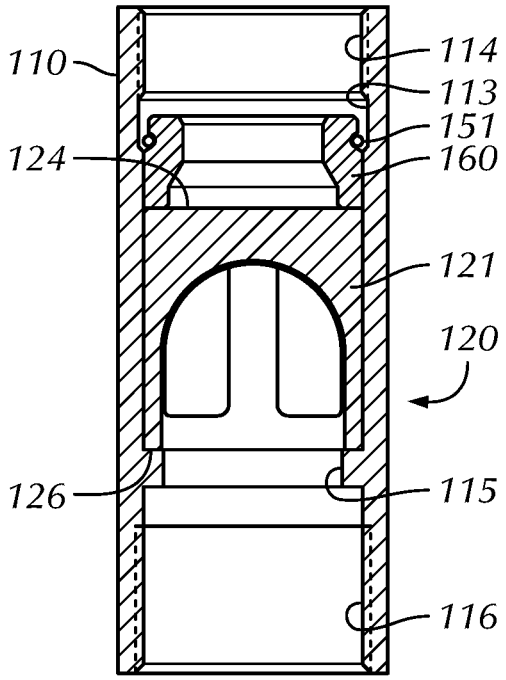
FIGS. 8A-8B illustrate sectional views of valve components during a stage of manufacture of a fourth type of valve assembly of the present disclosure.
Figure 8B:
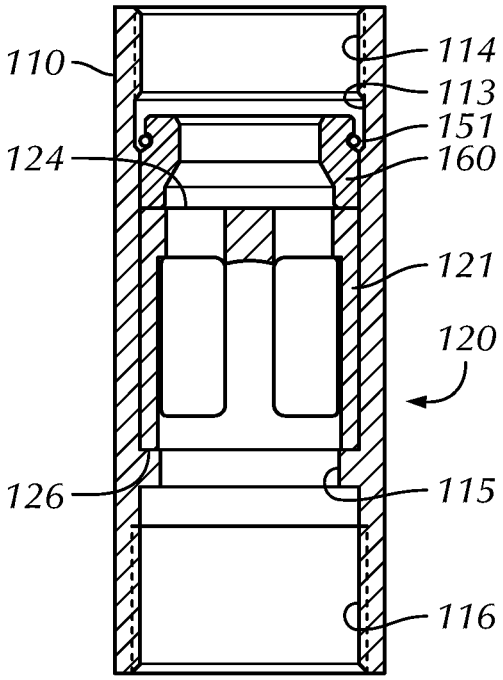

Turning to FIGS. 8A-8B, sectional views of valve components are illustrated during a stage of manufacture of a fourth type of valve assembly 100 of the present disclosure. This is a reverse of the previous arrangement, and similar reference numbers are used for the same components between configurations.

In the manufacture, the insert 120 installs in the flow passage 112 with the lower end 126 engaging the surface or shoulder 115 near the downhole end 116 of the housing 110. If suitable, an additional charge (not shown) of a brazing material could be used between the insert's lower end 126 and the shoulder 115.

A spacer 160 has a charge 151 of metallic material. The spacer 160 is positioned at the upper end 124 of the insert 120, and heating is applied to melt the charge 151 to form the metallurgical affixing between the spacer 160 and the flow passage 112.

As shown specifically here, the charge 151 can be a ring, strip, coil or the like of metallic material, which can be soldering or brazing material. As shown, a circumferential slot 169 can be provided around the spacer 160 and an annular slot 113 can be defined inside the flow passage 112 to facilitate the placement and wicking of the affixing material.

Once the insert 120 is metallurgically affixed, the configuration of FIGS. 8A-8B would then be assembled to include an upper adapter (not shown) threaded at the housing's uphole end 114. The seat (not shown) would install against the other side of the shoulder 115, and a lower adapter (not shown) would thread at the housing's lower thread 116. Gaskets (not shown) may be used for additional sealing.

Figure 9:
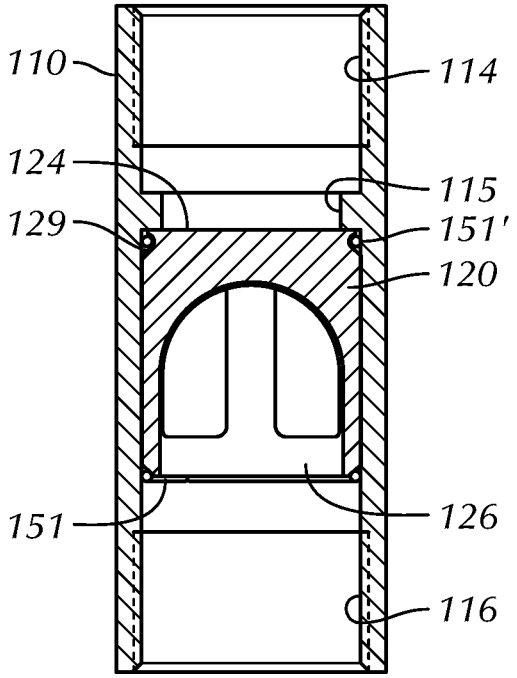
FIG. 9 illustrates a sectional view of valve components during a stage of manufacture of a fifth type of valve assembly of the present disclosure.

Turning to FIG. 9, a sectional view of valve components are illustrated during a stage of manufacture of a fifth type of valve assembly 100 of the present disclosure. Similar reference numbers are used for the same components between configurations and are not described again. In contrast to the previous configurations, the insert 120 metallurgically affixes at both ends 124 and 126 inside the flow passage 112. For example, a bevel 128 at the lower end 126 receives a charge 151 of metallic material to affix to the passage 112. The upper end 124 includes a circumferential slot 129 for another charge 151' of metallic material to affix to the passage 112. Heating applied as before could then melt the affixing material of the charges 151, 151' to both secure and seal the insert in the flow passage 112.

As shown here, the upper end 124 engages against the surface or shoulder 115, although an opposite arrangement could be used. As will be appreciated by the present example as well as previous ones, the insert 120 of the present disclosure can be metallurgically affixed inside the flow passage 112 in one or more locations.

Figure 10:
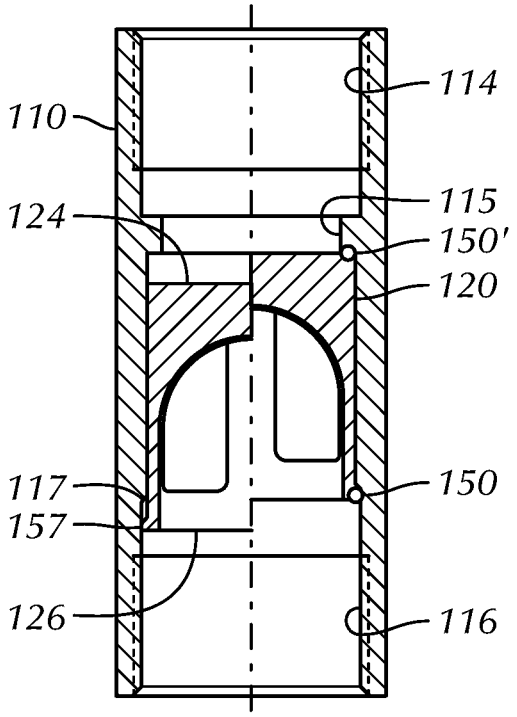
FIG. 10 illustrates a sectional view of valve components during a stage of manufacture of a sixth type of valve assembly of the present disclosure.

FIG. 10 illustrates a sectional view of valve components during a stage of manufacture of a sixth type of valve assembly 100 of the present disclosure. Similar reference numbers are used for the same components between configurations and are not described again. In contrast to the previous configurations, the insert 120 metallurgically affixes inside the flow passage 112 with a weldment of metallic material 150, which also produces the desired seal. The weldment of the metallic material 150 is composed of the solid-state joining of the two existing metallic materials from the housing 110 and the insert 120 so that no additional charge of material is needed (although it could be).

As shown on the left side of the figure, the lower end 126 of the insert 120 includes an outwardly protruding lip 157, and the flow passage 112 includes a complementary shoulder 117. During assembly as the insert 120 is inserted into the flow passage 112 so that the upper end 124 engages the shoulder 115, a solid state joining process, such as friction welding, creates the resulting weldment of the metallic material 150 between the insert 120 and the flow passage 112. The friction welding may alternatively or additionally form a resulting weldment of the metallic material 150' between the insert 120 and the shoulder 115, as also depicted.

To perform the friction welding, one or both of the housing 110 and the insert 120 are rotated so that the lip 157 and shoulder 117 weld together (as well as the fend 124 and the shoulder 115 if appropriate). Inductive heating can also be applied during the process. As will be appreciated in the friction welding process, a number of considerations are necessary, such as the types of material used, which of the housing and/or insert 120 is rotated, what dimensions are needed for the engaging lip 157 and shoulder 117 to make the desired weldment, what fixtures are needed to support the insert 120, and the like.

FIGS. 11A-11D illustrate a number of variations for setting the insert 120 inside the flow passage 112 of the housing 110. As noted previously, the surface 115 against which either the upper or lower end 124, 126 of the insert 120 is set can be a shoulder defined in the flow passage 112. As already hinted to above, use of a shoulder is not strictly necessary. For example, a feature such as a rim, a lip, a detent, a stop, or the like can be used. Moreover, the surface 115 can be an angling of the sidewall to create an interference fit, or it may simply be a point on the cylindrical sidewall of the flow passage 112.

Figure 11A:
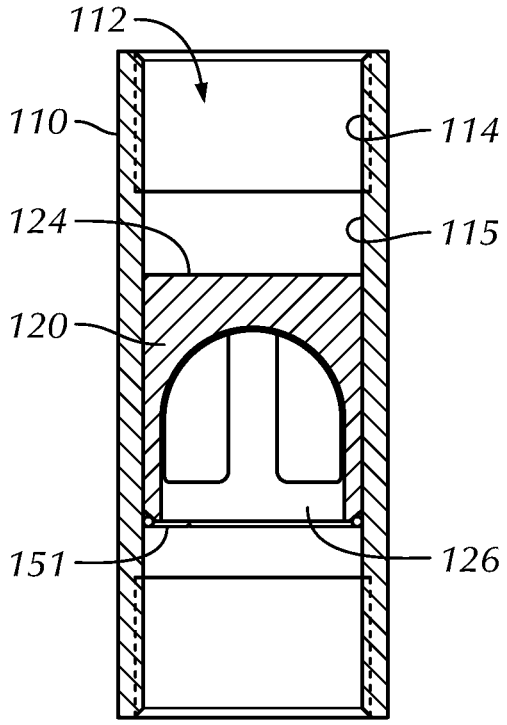
FIGS. 11A-11D illustrate a number of variations for setting the insert inside the flow passage of the housing.

For example, FIG. 11A shows the insert 120 set inside the flow passage 112 for metallurgically affixing therein (in this case using a charge 151 for brazing the lower end 126 to the flow passage 112). Instead of the upper end 124 engaging a protruding shoulder, the upper end 124 sets against or engages at a point on the surface 115 of the cylindrical sidewall of the flow passage 112. The metallurgical affixing disclosed herein can be sufficient to axially support the insert 120 in the flow passage 112 even under high compressive loads.

Figure 11B:
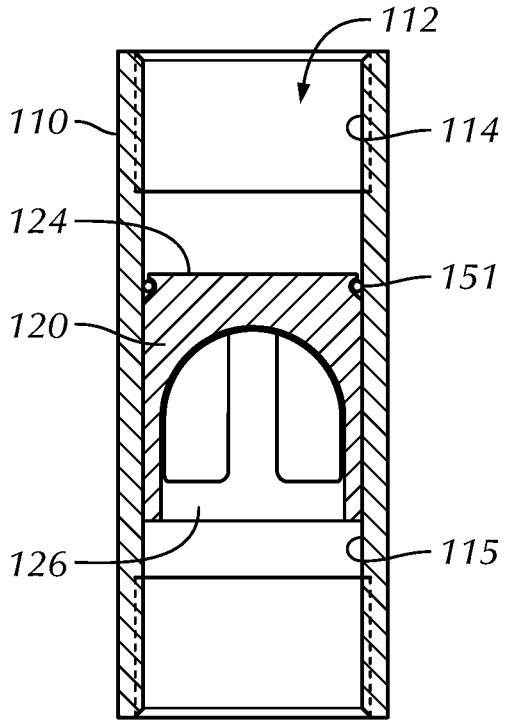

In the example of FIG. 11B, the insert 120 sets inside the flow passage 112 for metallurgically affixing therein (in this case using a charge 151 for brazing the upper end 124 to the flow passage 112). Instead of the lower end 126 engaging a protruding shoulder, the lower end 126 sets against or engages at a point on the surface 115 of the cylindrical sidewall of the flow passage 112.

Figure 11C:
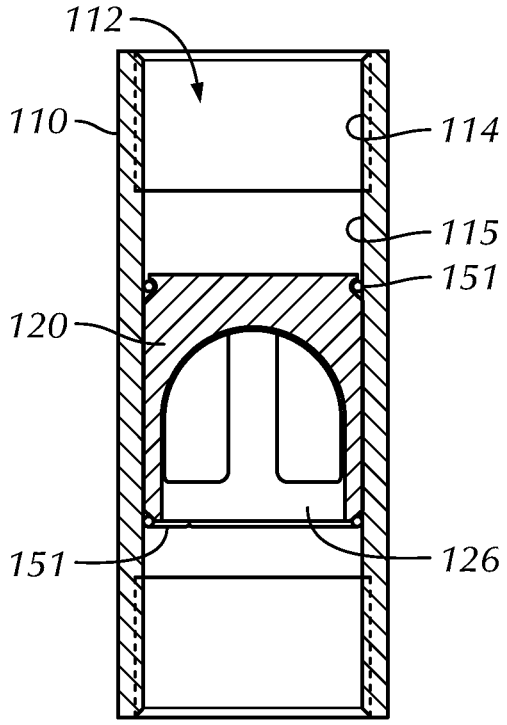

In the example of FIG. 11C, the insert 120 sets inside the flow passage 112 for metallurgically affixing therein (in this case using charges 151 for brazing the upper and lower ends 124, 126 to the flow passage 112). Instead of the lower end 126 engaging a protruding shoulder, the ends 124, 126 set against or engage at points on the surface 115 of the cylindrical sidewall of the flow passage 112.

Figure 11D:
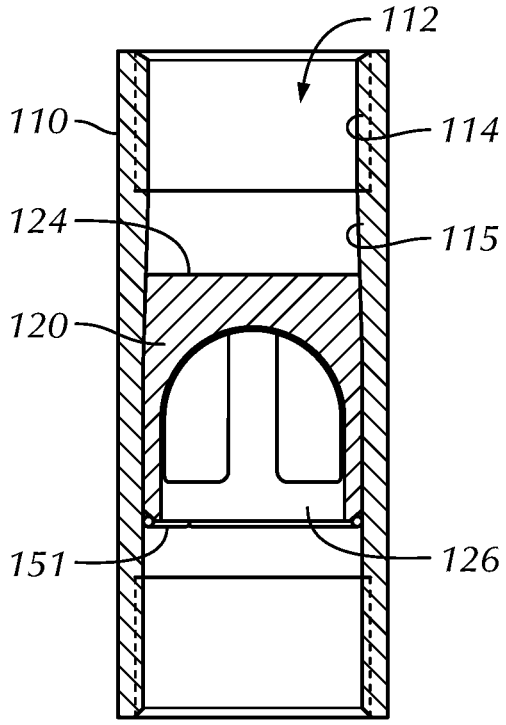

In the example of FIG. 11D, the insert 120 sets inside the flow passage 112 for metallurgically affixing therein (in this case using a charge 151 for brazing the lower end 126 to the flow passage 112). Instead of the upper end 124 engaging a protruding shoulder, the end 124 sets against or engage at an inwardly angled surface 115 of the sidewall of the flow passage 112. A reverse arrangement could be used, and brazing at both ends of the insert 120 could be performed.

Although not shown in FIGS. 11A-11D, it will be appreciated that any of the arrangements of the insert 120 having a body 121 and a spacer 160 can be similarly configured. In fact any of the arrangements having a body 121 and a spacer 160 for the insert 120, one or both ends of the insert's body 121 can be metallurgically affixed in the flow passage 112 in addition to the metallurgical affixing of the spacer 160.

Figure 12:
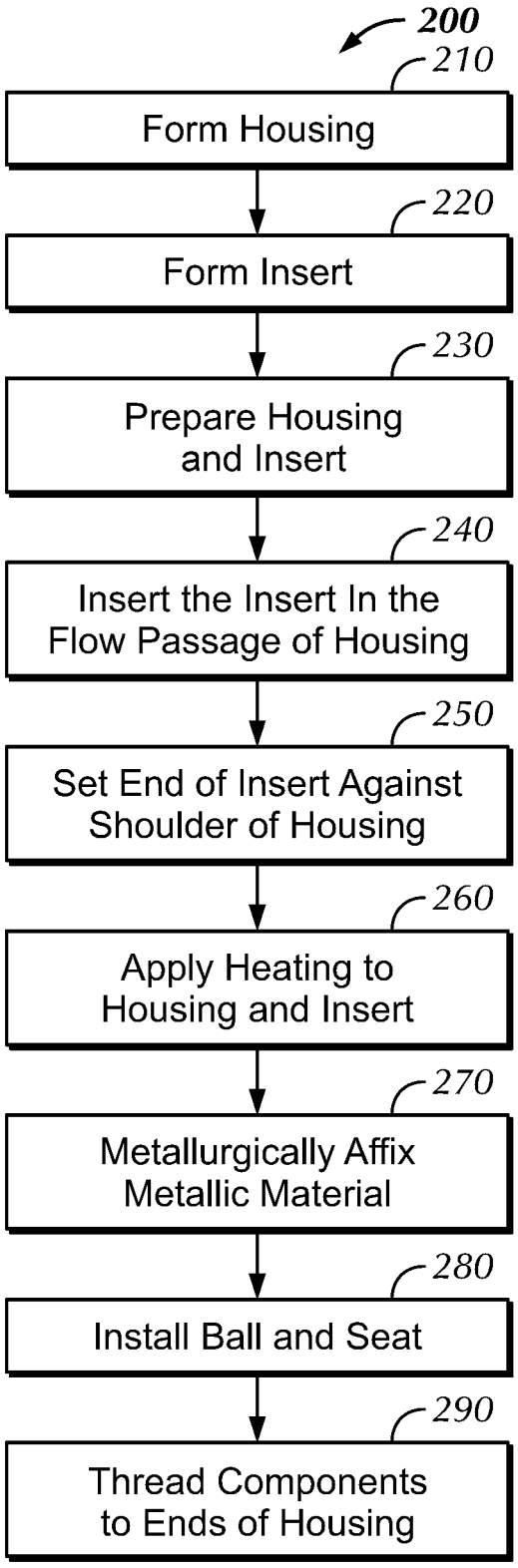
FIG. 12 illustrates a process of manufacturing a valve assembly of the present disclosure.

FIG. 12 illustrates a process 200 of manufacturing a valve assembly 100 of the present disclosure. (For understanding, reference will be made to components of the various configurations of valve assembly 100 discussed above.)

In the manufacture, the housing 110 and the insert 120 are formed (Blocks 210, 220). In particular, the housing 110 is machined to have the flow passage 112, the shoulder 115, and any internal grooves 113, or the like. The threads are formed on the ends 114, 116.

For its part, the insert 120 may be machined or may be cast from a suitable material, such as a STELLITE® material. The insert 120 is formed for flow therethrough and to have a ball stop 125, a ball passage 127, axial rails 123, flutes 123', and the like. If the insert 120 is made of a material other than a STELLITE® material or the like, various surfaces can be treated with hardened material in a welding process.

In preparation of assembly (Block 230), the housing 110 and the insert 120 are cleaned. If brazing or soldering is used, flux is applied to surfaces as needed.

For assembly, the insert 120 is inserted in the flow passage 112 of the housing (Block 240), and one of the ends 124, 126 is set against the shoulder 115 (Block 250), depending on the configuration.

The insert 120 is then secured in the housing 110 using brazing, soldering, or solid state joining (friction welding). In these steps, any charge 151 of the metallic material for brazing or soldering may be added to the end(s) of the insert 120 and/or the spacer 160 (if used), or the charge 151 may have already been disposed in any circumferential groove on the insert 120 and/or spacer before insertion into the flow passage 112. For friction welding, a charge 151 may not be used.

For brazing and soldering, heating is applied to the housing 110 and the insert 120. Heating can also be used for friction welding. For example, inductive heating can be applied by coils fit externally about the housing 110 at the location(s) of the charge(s) 151 or the joining surfaces for friction weldment.

The process 200 now metallurgically affixes the metallic material 150 between the flow passage 112 and at least a portion of the insert 120 (Block 270). To complete the assembly at any time after the manufacture, a ball 130 can be movably disposed in the flow passage 112 (Block 280) so that the ball 130 will be engagable with the ball stop 125 and passable through the ball passage 127. The ball seat 140 is then positioned in the flow passage adjacent the ball passage 127 of the insert 120 (Block 280). The additional components, such as adapters, are then threaded to the ends 114, 116 of the housing 110, and the assembly 100 can be added to other components of a downhole pump, such as a plunger body or barrel body.

In the metallurgically affixing of Step 270, for example, the upper end 124 of the insert 120 engages against the shoulder 115 as in FIG. 5A. The metallic material 150 can then metallurgically affix between the flow passage 112 and the lower end 126 of the insert 120. Alternatively, the lower end 126 can engage against the shoulder 115, for example, as in FIG. 6A. The metallic material 150 can then metallurgically affix the between the flow passage 112 and the upper end 124 of the insert 120.

Alternatively, for example, the insert's upper end 124 can engage against the shoulder 115, and a spacer separate from a body of the insert 120 can be inserted at the lower end 126, as in FIG. 7A. The metallic material 150 can then metallurgically affix between the flow passage 112 and the spacer 160. Alternatively, for example, the lower end 126 can engage against the shoulder 115, and a spacer 160 separate from a body 121 of the insert 120 can be inserted at the upper end 124, as in FIG. 8A. The metallic material 150 can then metallurgically affix between the flow passage 112 and the spacer 160. Further still, both upper and lower ends 124, 126 can be metallurgically affixed, as in FIGS. 9-10.

According to various configurations disclosed above, the insert 120 is secured to the housing 110 by means of brazing. This process can ensure that the insert 120 is sealed as well as permanently secured to the housing 110. A complete housing 110 is machined prior to placing and brazing the insert 120 therein. This form of assembly translates into shorter lead times and lower manufacturing costs. Depending on the materials used, several factors are configured for performing this process, such as the brazing material composition, the orientation of the insert (parallelism and flatness between the cage body axis is desired), flux type, amount of brazing material used (there needs to be a certain shear load carried by the brazed joint), and the brazing method.

According to the present disclosure, for example, the metallurgically affixing of the metallic material 150 between the flow passage 112 and at least a portion of the insert 120 can involve brazing a charge 151 of brazing material for the metallic material 150 between the flow passage 112 and at least the portion of the insert 120. The brazing material is positioned adjacent an annulus between the flow passage 112 and the insert 120, such as against the end of the insert 120, in a beveled edge 128, in a circumferential slot 129, or the like. Application of the heating to the housing 110 using an inductive coil H adjacent the brazing material then melts the brazing material, which wicks in the annular space and cools to secure and seal.

The brazing material used can be any suitable alloy for the application at hand and can be composed of a silver-based braze suited for 300-series stainless steels. For use with a STELLITE® insert 120 and housing 110 of MONEL® material, stainless steel or the like, the brazing material can be a sliver brazing filler metal having various combinations of silver Ag, copper Cu, zinc Zn, cadmium Cd, nickel NI, tin Sn, lithium Li, manganese Mn, and other elements.

A particularly useful brazing material may include by weight percent about 50% Ag±1%, 20% Cu±1%, 28% Zn±2%, and 2% Ni±0.5%. The general chemical composition of the brazing material can include AWS classification of BAg-24 (UNS P07505). Other commercially available brazing materials can be used, such as SILVALOY® 505 manufactured by Lucas-Milhaupt, Inc. or STAY-SILV® 50N manufactured by Harris Products Group. (SILVALOY® is a registered trademark of LUCAS-MILHAUPT WARWICK LLC, and STAY-SILV® is a registered trademark of LINCOLN GLOBAL, INC.)

The flux can be a black brazing flux for use with high silver brazing filler metals. Black flux turns transparent close to the brazing application temperature, which may be in the range of about 1000-1700° F. One useful flux includes STAY-SILV® black paste flux.

According to the present disclosure, the metallurgically affixing of the metallic material 150 between the flow passage 112 and at least a portion of the insert 120 can involve soldering a charge 151 of soldering material for the metallic material 150 between the flow passage 112 and at least the portion of the insert 120. The soldering material is positioned adjacent an annulus between the flow passage 112 and the insert 120, such as against the end of the insert 120, in a beveled edge 128, in a circumferential slot 129, or the like. Application of the heating to the housing 110 adjacent the soldering material then melts the soldering material, which wicks in the annular space and cools to secure and seal. Soldering may be suited for lower temperature applications because the solder may have a lower melting point of 500-F or the like. The soldering material used can be any suitable alloy for the application at hand and can be composed of silver and tin. A suitable soldering material would include Stay Brite #8 tin/silver solder, which has a weight percent of 5.5 to 6% silver and a remaining weight percent of tin. ASTM classification for this solder material is B32 Grade Sn95.

According to the present disclosure, the metallurgically affixing of the metallic material 150 between the flow passage 112 and at least a portion of the insert 120 can involve a solid state weldment of the material of the housing 110 and the insert 120. In the solid-state joining process, the housing 110 and the insert 120 can be composed of the same (or similar materials) or can be composed of different materials, such as MONEL® and STELLITE®. As will be appreciated, friction welding dissimilar materials such as MONEL® and STELLITE® would require proper parameters to be defined and may require some pre-heating to be perform. Application of inductive heating to the housing 110 can facilitate the solid-state joining process of spinduction.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A method of assembling a valve assembly of a downhole pump for a reciprocating pump system, the method comprising:

inserting an insert in a flow passage of a housing, the housing having first and second ends and defining the flow passage therethrough, the flow passage defining a surface between the first and second ends, the insert having third and fourth ends allowing for flow therethrough, the third end defining a ball stop, the fourth end having a ball passage;

setting one of the third and fourth ends of the insert against the surface in the flow passage; and securing the insert in the housing by brazing with a brazing material between at least a portion of the insert and the flow passage to metallurgically affix between at least the portion of the insert and the flow passage.

2. The method of claim 1, comprising initially forming the housing by machining the flow passage in the housing to define the surface between the first and second ends; and machining threads at the first and second ends for threading to other components of the downhole pump.

3. The method of claim 2, wherein machining the flow passage in the housing to define the surface between the first and second ends comprises forming a rim, a lip, a detent, a stop, or a shoulder in the flow passage, forming an inwardly angled portion of a sidewall of the flow passage, or forming a cylindrical portion of the sidewall of the flow passage.

4. The method of claim 1, comprising initially forming the insert by casting the insert with the ball stop and the ball passage.

5. The method of claim 1, wherein setting the one of the third and fourth ends of the insert against the surface and metallurgically affixing between at least the portion of the insert and the flow passage comprises:

engaging the third end of the insert against the surface, and metallurgically affixing between at least a portion of the fourth end of the insert and the flow passage;

engaging the fourth end against the surface, and metallurgically affixing between at least a portion of the third end of the insert and the flow passage;

engaging the third end of a body of the insert against the surface, inserting a spacer of the insert separate from the body toward the second end of the housing, and metallurgically affixing between at least a portion of the spacer and the flow passage;

engaging the fourth end of a body of the insert against the surface, inserting a spacer of the insert separate from the body toward the first end of the housing, and metallurgically affixing between at least a portion of the spacer and the flow passage; or engaging one of the third and fourth ends of the insert against the surface, and metallurgically affixing between at least a portion of both of the third and fourth ends of the insert and the flow passage.

6. The method of claim 1, further comprising:

positioning a ball movably disposed in the flow passage of the housing, engagable with the ball stop of the insert, and passable at least partially through the ball passage of the insert; and positioning a ball seat in the flow passage adjacent the fourth end of the insert having the ball passage.

7. The method of claim 6, wherein positioning the ball seat in the flow passage adjacent the fourth end of the insert comprises abutting the ball seat against the fourth end; or abutting the ball seat against an opposite side of the surface against which the fourth end abuts.

8. The method of claim 1, wherein brazing with the brazing material between at least the portion of the insert and the flow passage comprises initially positioning a charge of the brazing material adjacent an annular space between the insert and the flow passage and applying heat adjacent the brazing material.

9. The method of claim 8, wherein initially positioning the charge the brazing material adjacent the annular space between the insert and the flow passage comprises positioning the charge of the brazing material in a circumferential slot around the insert.

10. The method of claim 8, wherein applying the heat comprises using inductive heating with a coil disposed relative to the housing.

11. The method of claim 1, further comprising attaching the first end of the housing to a plunger of the downhole pump or to a barrel of the downhole pump.

12. A downhole pump for a reciprocating pump system having a rod string disposed in a tubing string, the downhole pump comprising a valve assembly assembled according to the method of claim 1.

13. A valve assembly for a downhole pump, the assembly comprising:

a housing disposed on the pump, the housing having first and second ends and defining a flow passage therethrough, the flow passage defining a surface between the first and second ends; and an insert disposed in the housing, the insert having third and fourth ends allowing for flow therethrough, the third end defining a ball stop, the fourth end having a ball passage, at least one of the third and fourth ends engaging the surface of the housing, at least a portion of the insert metallurgically affixed to the flow passage, wherein the insert defines a circumferential groove thereabout and comprises a charge of metallic material in the circumferential groove for the metallurgical affixation to the flow passage.

14. The assembly of claim 13, wherein the first end of the housing defines first threads for threading to a first component of the downhole pump; and wherein the second end of the housing defines second threads for threading to a second component of the downhole pump.

15. The assembly of claim 13, wherein:

the third end of the insert engages the surface, and at least a portion of the fourth end of the insert is metallurgically affixed to the flow passage;

the fourth end of the insert engages the surface, and at least a portion of the third end of the insert is metallurgically affixed to the flow passage;

the third end of the insert comprises a body of the insert engaging the surface, and the fourth end of the insert comprises a spacer separate from the body of the insert, the spacer being disposed against the body and being metallurgically affixed in the flow passage;

the fourth end of the insert comprises a body of the insert engaging the surface, and the third end of the insert comprises a spacer separate from the body of the insert, the spacer being disposed against the body and being metallurgically affixed in the flow passage; or the one of the third and fourth end of the insert engages the surface, and at least a portion of both of the third and fourth ends of the insert are metallurgically affixed to the flow passage.

16. The assembly of claim 13, further comprising:

a ball seat disposed in the flow passage adjacent the fourth end having the ball passage; and a ball movably disposed in the flow passage of the housing, engagable with the ball stop of the insert, passable at least partially through the ball passage of the insert, and seatable in the ball seat.

17. The assembly of claim 16, wherein the ball seat abuts against the fourth end of the insert or abuts against an opposite side of the surface against which the fourth end of the insert abuts.

18. The assembly of claim 13, wherein the metallurgical affixation and the surface secures the insert in the flow passage without compressive load across the third and fourth ends of the insert.

19. The assembly of claim 13, wherein the metallurgical affixation seals the insert in the flow passage preventing flow through an annular space between the insert and the flow passage.

20. The assembly of claim 13, wherein the charge of the metallic material for the metallurgical affixation comprises:

a brazing material brazing at least the portion of the at least one of the third and fourth ends of the insert in the flow passage;

a soldering material soldering at least the portion of the at least one of the third and fourth ends of the insert in the flow passage; or a solid-state weldment joining at least the portion of the at least one of the third and fourth ends of the insert in the flow passage.

21. The assembly of claim 20, wherein the housing comprises a nickel-copper alloy; wherein the insert comprises a cobalt-chromium alloy; and wherein the brazing material comprises a silver-based alloy.

22. A valve assembly for a downhole pump, the assembly comprising:

a housing disposed on the pump, the housing having first and second ends and defining a flow passage therethrough, the flow passage defining a surface between the first and second ends; and an insert disposed in the housing, the insert having third and fourth ends allowing for flow therethrough, the third end defining a ball stop, the fourth end having a ball passage, at least one of the third and fourth ends engaging the surface of the housing, at least a portion of the insert metallurgically affixed to the flow passage, wherein the flow passage defines an annular groove therein, the insert having a charge of metallic material disposed thereon and positioned adjacent the annular groove for the metallurgical affixation.

23. The assembly of claim 22, wherein the charge of the metallic material for the metallurgical affixation comprises:

a brazing material brazing at least the portion of the at least one of the third and fourth ends of the insert in the flow passage;

a soldering material soldering at least the portion of the at least one of the third and fourth ends of the insert in the flow passage; or a solid-state weldment joining at least the portion of the at least one of the third and fourth ends of the insert in the flow passage.

24. A downhole pump for a reciprocating pump system having a rod string disposed in a tubing string, the pump comprising:

a barrel disposed in the tubing string and having a standing valve assembly; and a plunger coupling to the rod string and movably disposed in the barrel, the plunger having a traveling valve assembly, wherein at least one of the standing and traveling valve assemblies comprises a valve assembly according to claim 13.

25. A method of assembling a valve assembly of a downhole pump for a reciprocating pump system, the method comprising:

inserting an insert in a flow passage of a housing, the housing having first and second ends and defining the flow passage therethrough, the flow passage defining a surface between the first and second ends, the insert having third and fourth ends allowing for flow therethrough, the third end defining a ball stop, the fourth end having a ball passage;

setting one of the third and fourth ends of the insert against the surface in the flow passage; and securing the insert in the housing by soldering with a soldering material between at least a portion of the insert and the flow passage to metallurgically affix between at least the portion of the insert and the flow passage.

26. A method of assembling a valve assembly of a downhole pump for a reciprocating pump system, the method comprising:

inserting an insert in a flow passage of a housing, the housing having first and second ends and defining the flow passage therethrough, the flow passage defining a surface between the first and second ends, the insert having third and fourth ends allowing for flow therethrough, the third end defining a ball stop, the fourth end having a ball passage;

engaging one of the third and fourth ends of the insert against the surface in the flow passage; and securing the insert in the housing by metallurgically affixing between at least a portion of the other of the third and fourth ends of the insert and the flow passage.

27. The method of claim 26, further comprising securing the insert in the housing by metallurgically affixing between at least the portion of the one of the third and fourth ends of the insert and the flow passage.

28. The method of claim 26, wherein metallurgically affixing comprises brazing with a brazing material between at least the portion of the insert and the flow passage, soldering with a soldering material between at least the portion of the insert and the flow passage, or solid-state joining between at least the portion of the insert and the flow passage.

29. The method of claim 26, wherein securing the insert in the housing by metallurgically affixing between at least the portion of the other of the third and fourth ends of the insert and the flow passage comprises:

inserting a spacer of the insert, separate from a body of the insert, toward one of the first and second ends of the housing; and securing the body of the insert in the housing by metallurgically affixing between at least a the portion of the spacer and the flow passage.

* * * * *